US007765609B2

(12) United States Patent
Chase

(10) Patent No.: US 7,765,609 B2
(45) Date of Patent: Aug. 3, 2010

(54) SPECIALIZED INFANT PROTECTIVE COVER

(75) Inventor: Annika Chase, Costa Mesa, CA (US)

(73) Assignee: Baby Admin Designs, LLC, Irvine, CA (US)

( * ) Notice: Subject to any disclaimer, the term of this patent is extended or adjusted under 35 U.S.C. 154(b) by 0 days.

(21) Appl. No.: 12/463,328

(22) Filed: May 8, 2009

(65) Prior Publication Data

US 2010/0017930 A1 Jan. 28, 2010

Related U.S. Application Data

(60) Provisional application No. 61/083,414, filed on Jul. 24, 2008.

(51) Int. Cl.
*A41D 13/04* (2006.01)

(52) U.S. Cl. ..... 2/46; 2/48; 2/49.4

(58) Field of Classification Search ..... 2/46, 2/48, 49.1, 49.4, 52, 49.2, 49.5, 50, 51, 104, 2/463, 459, 92, 207

See application file for complete search history.

(56) References Cited

U.S. PATENT DOCUMENTS

| | | | | | |
|---|---|---|---|---|---|
| 593,618 | A | * | 11/1897 | Stackhouse | 2/49.5 |
| 889,073 | A | * | 5/1908 | Walbridge | 2/49.1 |
| D39,760 | S | * | 1/1909 | Moses | D2/860 |
| 2,479,154 | A | * | 8/1949 | Cantor | 2/48 |
| 2,482,182 | A | * | 9/1949 | Henninger | 2/48 |
| 2,552,462 | A | * | 5/1951 | Savrin | 2/49.2 |
| 2,563,420 | A | | 8/1951 | Roe | |
| 2,674,739 | A | | 4/1954 | Barnett | |
| 2,697,223 | A | * | 12/1954 | Geisinger | 2/52 |
| 2,722,685 | A | * | 11/1955 | Lucas | 2/48 |
| 2,727,239 | A | * | 12/1955 | Simon | 2/49.2 |
| 2,831,193 | A | * | 4/1958 | Terry | 2/46 |
| 2,857,599 | A | | 10/1958 | Wallace | |
| 2,955,293 | A | * | 10/1960 | Peterson | 2/48 |
| 3,945,048 | A | | 3/1976 | Shearer | |
| 4,710,979 | A | | 12/1987 | Bull et al. | |
| D299,282 | S | * | 1/1989 | Winans | D2/861 |
| 4,811,428 | A | | 3/1989 | Waldman et al. | |
| 4,829,601 | A | | 5/1989 | Spanier | |
| 4,862,518 | A | | 9/1989 | Williams et al. | |
| 4,965,888 | A | | 10/1990 | Jones | |
| 5,005,217 | A | | 4/1991 | Bern et al. | |
| 5,036,547 | A | | 8/1991 | Silas | |
| 5,074,013 | A | | 12/1991 | Arnold et al. | |
| 5,100,399 | A | | 3/1992 | Janson et al. | |

(Continued)

*Primary Examiner*—Amy B Vanatta
(74) *Attorney, Agent, or Firm*—Jafari Law Group, Inc.

(57) ABSTRACT

The invention is an apparatus and method for a protective cover to protect a user's shoulder area during such activities as burping, feeding, or playing with an infant. The cover has two grooves, one to contour around the user's neck region, and another to contour the user's arm region. In one embodiment of the present invention, the cover has multiple layers, wherein least one of the layers is made of a high friction fabric to prevent the cover from slipping off the user's shoulder. In another embodiment of the present invention two elasticized straps are attached to the cover and wrap around the user's neck to prevent the cover from slipping off the user's shoulder. The straps are convenient and easy to use, allowing one to either slip the cover over one's head or quickly fasten or unfasten around the neck.

9 Claims, 5 Drawing Sheets

U.S. PATENT DOCUMENTS 5,457,820 A 10/1995 Yielding
5,459,877 A 10/1995 Roberti
5,468,152 A 11/1995 Lenart
5,483,701 A 1/1996 Ferreyros
5,490,289 A 2/1996 Lehrer
D375,187 S * 11/1996 Shoemate ..... D2/861
5,661,851 A * 9/1997 Sanchez ..... 2/49.4
5,666,665 A 9/1997 Morgado
5,701,605 A 12/1997 Bowen
6,122,771 A 9/2000 Cook et al.
6,256,788 B1 7/2001 Loewer et al.
6,327,712 B1 12/2001 Armstrong et al.
6,345,392 B1 2/2002 Rios
6,505,367 B2 1/2003 Griffin et al.
6,745,399 B1 6/2004 Austin
7,082,617 B1 * 8/2006 Poindexter et al. ..... 2/48
7,174,571 B1 2/2007 Vonrinteln
7,185,370 B2 3/2007 Greear-Astaud et al.
7,228,570 B2 6/2007 Willis
7,269,855 B2 9/2007 LaRocco
7,269,856 B1 * 9/2007 Cannan ..... 2/49.1
2006/0010558 A1 1/2006 Prater
2006/0026728 A1 2/2006 Shaw
2007/0006357 A1 1/2007 Hall
2007/0011795 A1 1/2007 Davenport
2007/0214549 A1 * 9/2007 Carr ..... 2/312
2008/0201815 A1 * 8/2008 Barclay ..... 2/48
2008/0263740 A1 * 10/2008 Wright et al. ..... 2/49.1
2009/0089910 A1 * 4/2009 Lopez ..... 2/52

* cited by examiner

SPECIALIZED INFANT PROTECTIVE COVER

PRIORITY NOTICE

The present application claims priority under 35 U.S.C. §119(e) to U.S. Provisional Patent Application Ser. No. 61/083,414 filed on Jul. 24, 2008, the disclosure of which is incorporated herein by reference in its entirety.

TECHNICAL FIELD OF THE INVENTION

The present invention relates in general to a method and apparatus that protects a user's shoulder region while burping, feeding, or playing with an infant. More specifically, the invention relates to a method and apparatus that stays securely on the user's shoulder and therefore effectively protects the user's shoulder region during burping, feeding, or playing with an infant.

COPYRIGHT & TRADEMARK NOTICE

A portion of the disclosure of this patent application may contain material that is subject to copyright protection. The owner has no objection to the facsimile reproduction by any one of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and shall not be construed as descriptive or to limit the scope of this invention to material associated only with such marks.

BACKGROUND OF THE INVENTION

It is well known to parents, caregivers, nannies and others that certain aspects of feeding an infant can be quite laborious, including dealing with a variety of messes that may occur with an infant as a result of being fed.

In particular, when an infant is being burped after being fed, the infant may expel food, fluids, saliva, drool, vomit, or other substances that can result in an unsightly and inconvenient mess for the person feeding or burping the child.

The types of burp cloths typically found in the art are mere pieces of varying shapes of cloths, usually rectangular or square-shaped, which the user will drape over her shoulder before attempting to burp the infant.

Although the user may use a burp cloth while burping the infant, she may typically have to deal with repositioning the burp cloth due to the infant's movements. This can inconvenience the user in that she may have to use her available hand to reposition the burp cloth while still holding the infant, or even place the infant down in order to fix the cloth's position.

Additionally, the propensity for a burp cloth to slip off or become dislodged while the infant is being burped contributes to an even higher chance that the infant will soil the user's shoulder region when the infant expels food or saliva.

There is a need in the art for a specialized infant burp cloth. Specifically, there is a need for a specialized infant burp cloth that does not slip off the user's shoulder. It is to these ends that the present invention has been developed.

SUMMARY OF THE INVENTION

To minimize the limitations in the prior art, and to minimize other limitations that will be apparent upon reading and understanding the present specification, the present invention describes a protective cover to be used while burping, feeding, or playing with infants that has a strap or plurality of straps that wrap around the neck of the user so that the protective cover stays in place on the shoulder of the user. The protective cover also has a high friction fabric on the underside of the cover to help keep the cover in place on the shoulder of the user.

An apparatus according to the present invention may comprise a fabric with a first groove that is configured to contour a neck region of a person, a second groove that is configured to contour an arm region of the person, and a strap that is attached to the fabric and configured to securely wrap around a neck of the person.

Additionally, an apparatus according to the present invention may comprise a fabric with a first groove that is configured to contour a neck region of a person, and a second groove that is configured to contour an arm region of the person.

A method according to the present invention may comprise the steps of placing a cover, comprising a fabric including a first groove configured to contour a neck region of a person, a second groove configured to contour an arm region of the person, and a strap, on the person's shoulder region; placing the infant's head on or near the cover; and feeding, burping, or playing with the infant.

It is an objective of the present invention to provide the user with a specialized cover that maintains its position on the user's shoulder, thereby relieving the user from the inconvenience of displacement that typically occurs with other types of cloths or fabric pieces used while burping an infant.

It is another objective of the present invention to prevent potential infant messes, such as the expulsion of food, saliva, fluids, or vomit, which may occur during the burping, feeding, or playing with an infant, from getting onto the user's shoulder region.

It is another objective of the present invention to protect the user's clothing as well as any accessories worn by the user during burping, feeding, or playing with an infant.

It is another objective of the present invention to protect the user's skin or hair during burping, feeding, or playing with an infant.

These and other advantages and features of the present invention are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE DRAWINGS

In the following discussion that addresses a number of embodiments and applications of the present invention, reference is made to the accompanying drawings that form a part hereof, where depictions are made, by way of illustration, of specific embodiments in which the invention may be practiced. It is to be understood that other embodiments may be utilized and changes may be made without departing from the scope of the present invention.

For background and explanatory purposes, the term infant may include, without limiting the scope of the present invention, infants, newborns, tots, kids, babies, toddlers, or young children that may, for example, be fed, burped, or played with on a person's shoulder region.

Similarly, the term shoulder region may include, without limiting the scope of the present invention, the shoulder region, as well as the clothing, accessories, skin, or hair at or near a person's shoulder region.

Figure 1:
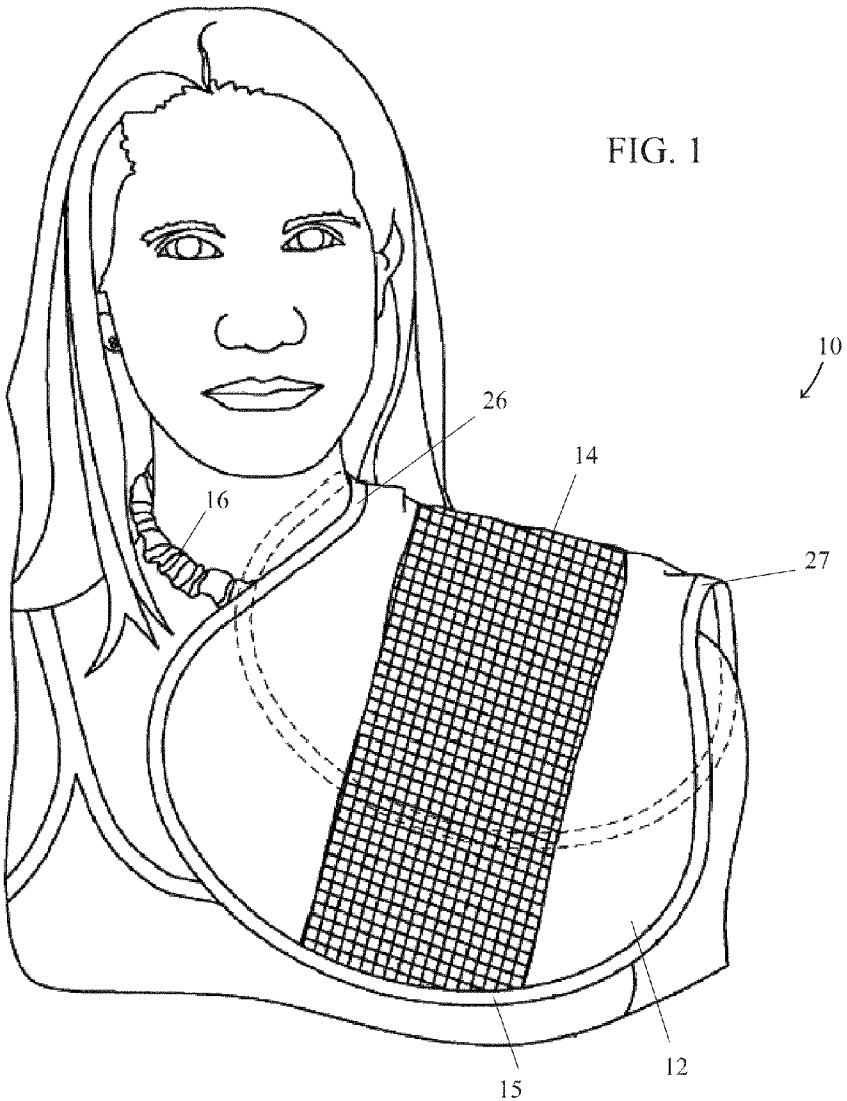
FIG. 1 illustrates an exemplary embodiment of the present invention of a specialized infant cover worn by a user.

Turning to the first figure, FIG. 1 illustrates an exemplary embodiment of the present invention as worn by a user. Specifically, FIG. 1 shows protective cover 10, comprising top layer of fabric 12, first groove 26 configured to contour a neck region of a person, second groove 27 configured to contour around an arm region of the person, higher absorptive capacity region 14, trim region 15 encompassing an outer region of fabric, and strap 16 configured to securely wrap around a neck of the person.

FIG. 1 illustrates an exemplary use of cover 10. Cover 10 may be placed on a user's shoulder. Cover 10 may be placed on the shoulder in such a manner that first groove 26, which may be configured to contour a neck region of a person, is placed adjacent to the neck of the person. Also, cover 10 may be placed on the shoulder in such a manner that second groove 27, which may be configured to contour an arm region of the person, is placed adjacent to the arm of the person. In the exemplary use of cover 10, the user may apply strap 16 around her neck to ensure cover 10 will stay in place on her shoulder.

Top layer of fabric 12 may be made of cotton. In one embodiment top layer of fabric 12 may be made of a decorative cloth. However, in other embodiments of the present invention, top layer of fabric 12 may be comprised other fabrics or materials without limiting the scope of the present invention.

As shown in FIG. 1, higher absorptive capacity region 14 may be located substantially in the center region of cover 10 because the center region may be the region which may receive the brunt of the expulsions from the infant. In an exemplary embodiment of the present invention, higher absorptive capacity region 14 may comprise a narrow strip extending from end to end in center of cover 10, perpendicular to a line intersecting the apexes of first groove 26 and second groove 27. In another embodiment of the present invention, however, higher absorptive capacity region 14 may encompass the entirety of cover 10. Thus, the width of higher absorptive capacity region 14 should not be interpreted so as to limit the scope of the present invention.

Higher absorptive capacity region 14 may be stitched onto cover 10. In other embodiments of the present invention, however, higher absorptive capacity region 14 may be attached to cover 10 by an adhesive, mechanical connectors, or other similar means.

Without limiting the scope of the invention, higher absorptive capacity region 14 has higher absorptive capacity because it may be made of material with high absorptive capacity than top layer of fabric 12, such as lyocell or of multiple layers of lyocell. Alternatively, higher absorptive capacity region 14 may be comprised of several layers of a typical cloth material such as cotton. In an alternative embodiment, higher absorptive capacity region 14 may comprise a combination of lyocell and cotton. In another embodiment, higher absorptive capacity region 14 may comprise a decorative cloth.

As shown in FIG. 1, trim region 15 encompasses an outer region of a fabric. In one embodiment, trim region 15 may be stitched onto the outer region of the fabric. For example, without limiting the scope of the present invention, trim region 15 encompassing the outer region of the fabric may be made of cotton. In one embodiment, trim region 15 may be made of highly absorptive fabrics, such as lyocell. In another embodiment, trim region 15 may be made of a combination of lyocell and cotton. In yet another embodiment, trim region 15 may be made of a decorative cloth.

As shown in FIG. 1, strap 16 may be attached to the underside of cover 10. Strap 16 may be attached to the fabric and may be configured to securely wrap around the neck of a person. In exemplary usage of the present invention, strap 16 may ensure that cover 10 remains securely on a shoulder of the person. In such exemplary usage, strap 16 may prevent the protective cover 10 from sliding off the shoulder of the person.

In the exemplary embodiment of the present invention, strap 16 may be permanently attached to the underside of cover 10. However, in other embodiments of cover 10, strap 16 may be attached to the top layer of fabric 12 or to the outer region or edge of the cover 10. In another embodiment, strap 16 may be made of an elastic material to facilitate ease of wrapping strap 16 around the neck of the user. In yet another embodiment, a decorative fabric may be stitched onto strap 16.

In alternative embodiments of the present invention, a plurality of straps 16 may be attached to cover 10. In another embodiment, strap 16 may be removably attached to cover 10. In such an embodiment, strap 16 may be securely attached to and removed from cover 10. For example, and without limiting the scope of the invention, strap 16 may be made of thermoplastic polyurethane (TPU) elastic.

Figure 2:
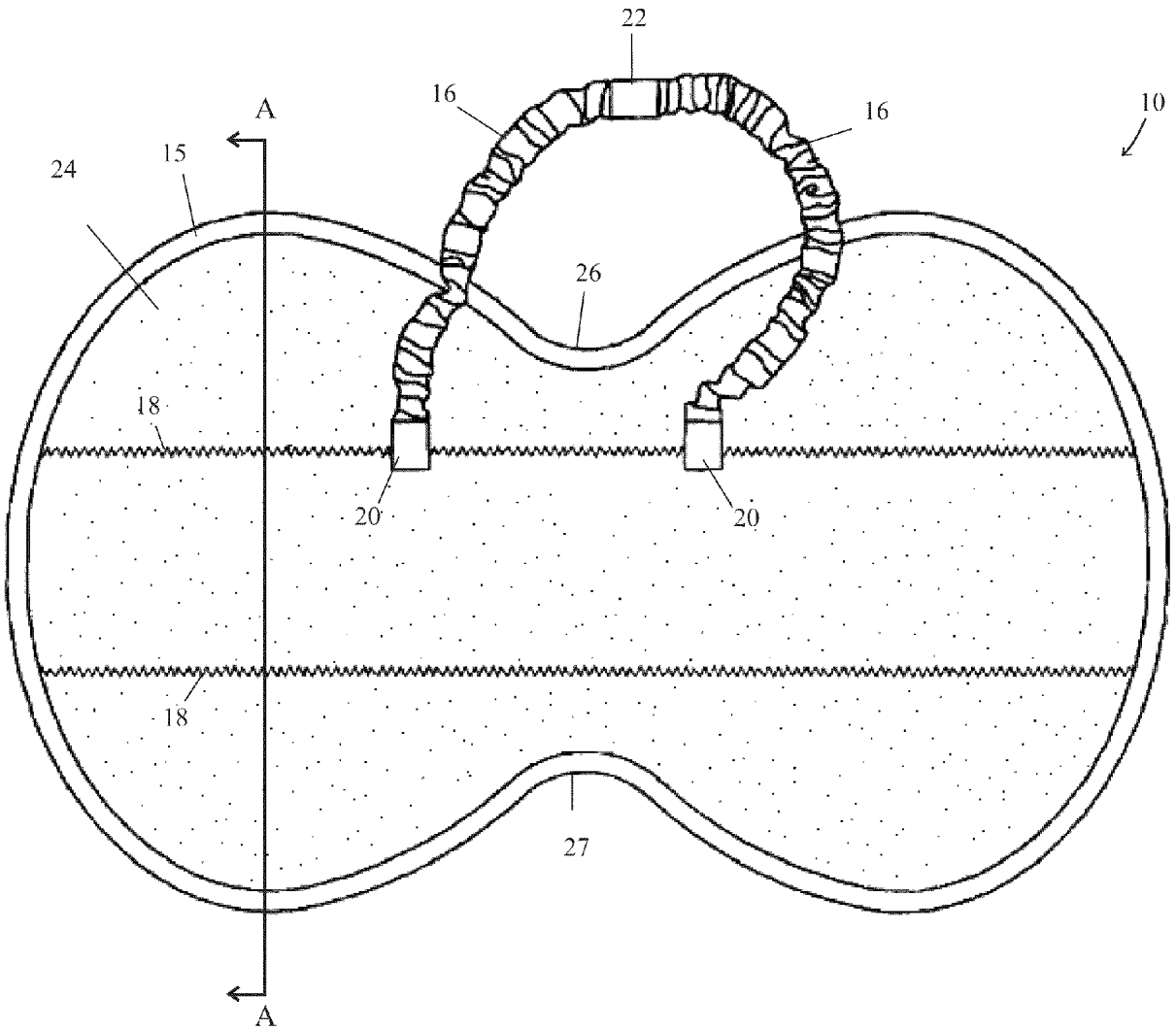
FIG. 2 illustrates the underside of one embodiment of the present invention with straps fastened.

Turning to the next figure, FIG. 2 illustrates the underside of one embodiment of the present invention with straps 16 fastened. Specifically, protective cover 10, comprising, first groove 26 configured to contour a neck region of a person, second groove 27 configured to contour around the arm region of a person, straps 16, stitching 20 that connects straps 16 to bottom layer of high friction fabric 24, hook and loop fastener 22, stitching 18 that connects higher absorptive capacity region 14 to cover 10, and trim region 15 encompassing an outer region of cover 10.

As depicted in FIG. 2, the underside of protective cover 10 may be comprised of bottom layer of high friction fabric 24 so that cover 10 remains securely on a shoulder of a person so that it does not slide off the shoulder of the person. FIG. 2 also depicts cross section A-A, which will be explained in further detail in FIG. 5.

For example, and without limiting the scope of the invention, bottom layer of high friction fabric 24 may be made of a material that has a high friction, but one that will not damage or otherwise affect the user's skin or clothing. For example, bottom layer of high friction fabric 24 may be made of felt to ensure cover 10 remains securely on the shoulder of the person, yet the felt material may not damage or irritate the user's clothing or skin.

Higher absorptive capacity region 14 may be stitched onto cover 10. In such an embodiment, stitching 18 may be seen from the underside of the present invention as is depicted in FIG. 2. In another embodiment of the present invention, higher absorptive capacity region 14 may be glued onto the cover. In yet another embodiment, however, higher absorptive capacity region 14 may be attached to cover 10 by hook and loop fastener. In an exemplary usage of such an embodiment, higher absorptive capacity region 14 may be replaceable or disposable with another higher absorptive capacity region 14. As such, the user may remove cover 10 for cleaning and replace higher absorptive capacity region 14 with an alternate one.

In the exemplary embodiment of the present invention, cover 10 may be comprised of two straps 16 with stitching 20 connecting two straps 16 to bottom layer of fabric 24. In one embodiment, straps 16 may be connected by a hook and loop fastener 22 to attach to one another. Alternatively, in another embodiment, straps 16 may be connected by one or more buttons or snaps in order to attach to one another. In yet another embodiment, straps 16 may attach to one another by tying into a knot so that the user can adjust how tight or loose straps 16 are around his or her neck.

Figure 3:
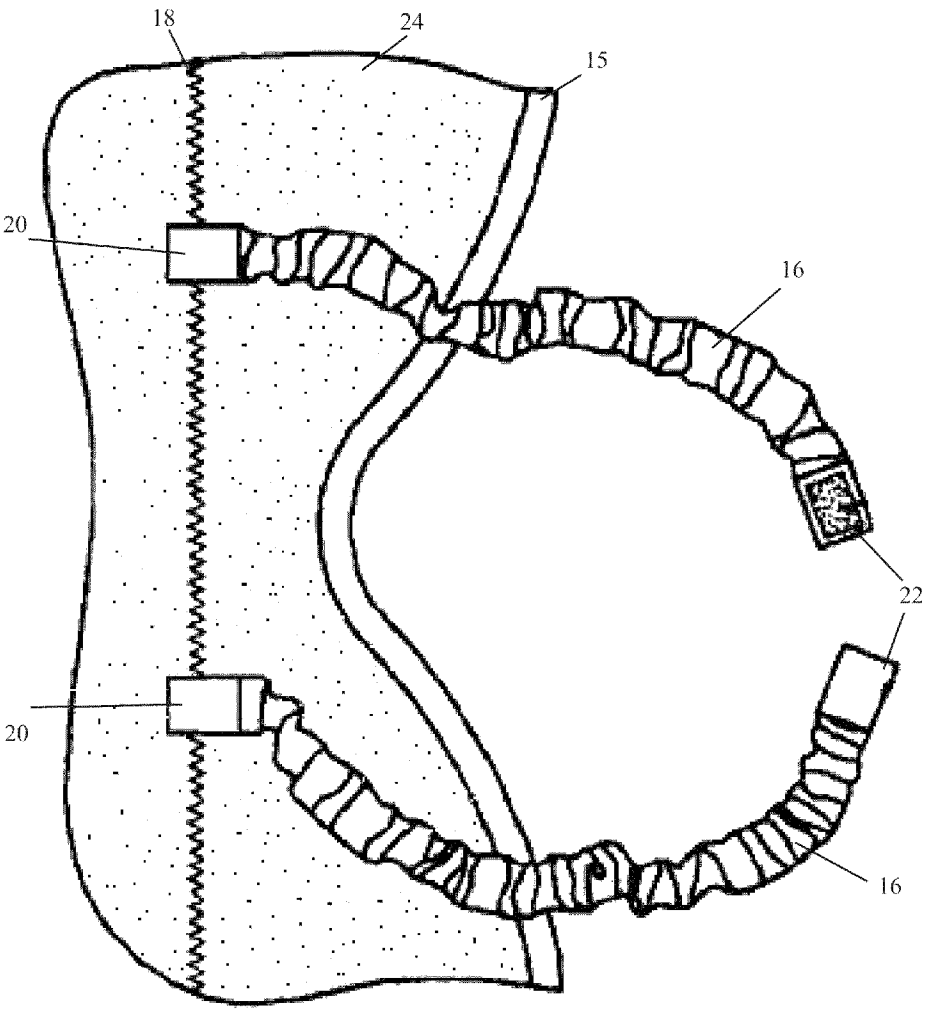
FIG. 3 illustrates the underside of one embodiment of the present invention with straps unfastened.

Turning to the next figure, FIG. 3 illustrates a close-up view of the underside of one embodiment of the present invention with straps 16 unfastened. Specifically, protective cover 10, comprising bottom layer of high friction fabric 24, stitching 18 that connects higher absorptive capacity region 14 to cover 10, trim region 15 encompassing an outer region of cover 10, straps 16, stitching 20 that connects straps 16 to bottom layer of high friction fabric 24, and hook and loop fastener 22.

In one embodiment, as shown in FIG. 3, straps 16 may have hook and loop fasteners 22 so that straps 16 may attach and detach from one another as needed by the user. As depicted, straps 16 may be connected by a hook and loop fastener 22 to attach to one another. Alternatively, in another embodiment, straps 16 may be connected by one or more buttons or snaps in order to attach to one another. In yet another embodiment, straps 16 may attach to one another by tying into a knot so that the user can adjust how tight or loose straps 16 are around his or her neck. Without limiting the scope of the invention, straps 16 may be of any length sufficient to wrap, be connected or adjusted around the neck of the user so that a user of varying shapes and sizes may comfortably utilize the present invention.

Straps 16 may be attached by stitching 20 to cover 10 by a hook and look fastener. Alternatively, in another embodiment, straps 16 may be attached to cover 10 via buttons, snaps or other similar connective means without limiting the scope of the invention. As depicted in FIG. 3, straps 16 may be permanently attached to the underside of cover 10. However, in another embodiment of cover 10, straps 16 may be attached to the top layer of fabric 12 or to the outer region or edge of the cover 10.

Figure 4:
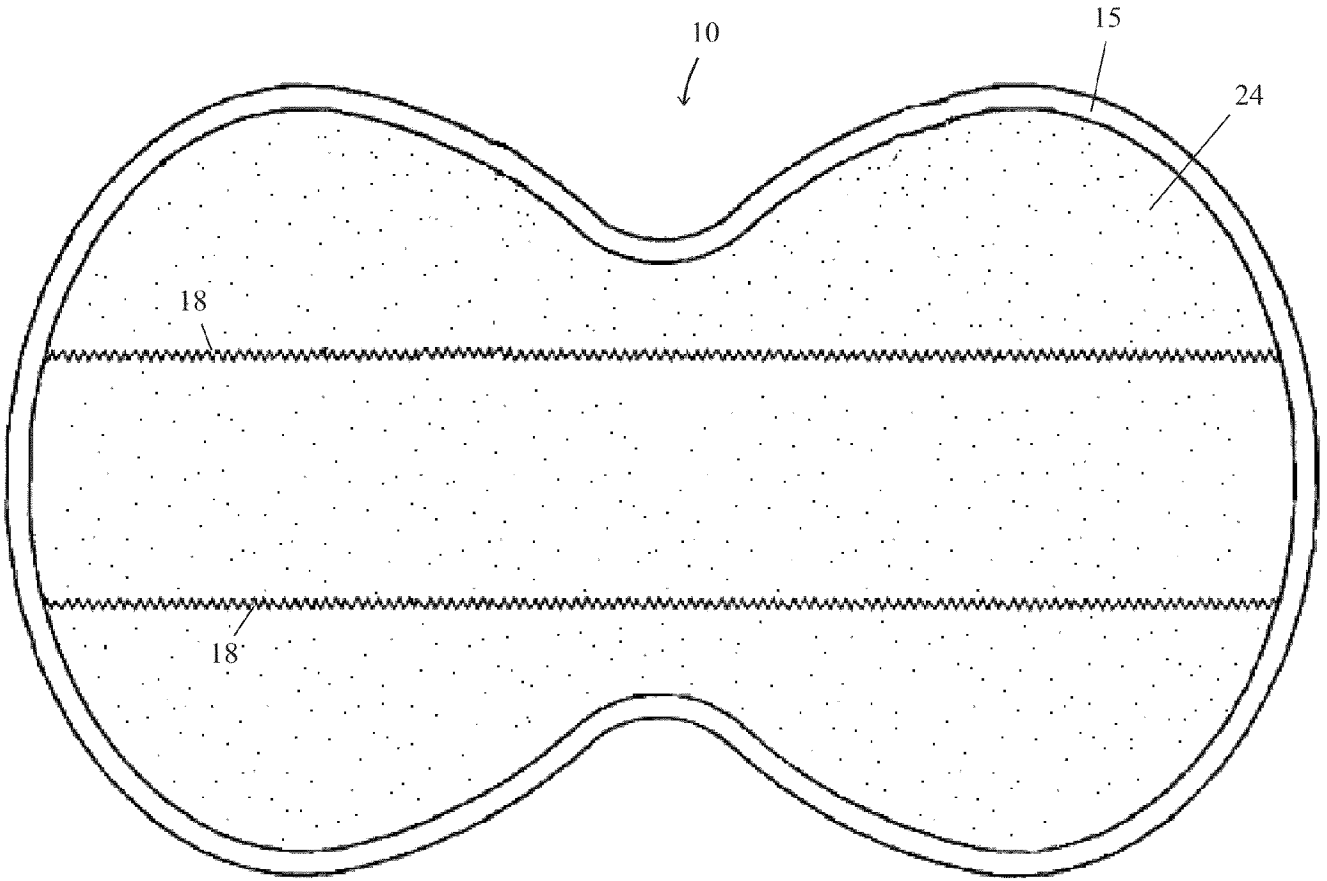
FIG. 4 illustrates the underside of another embodiment of the present invention without straps.

Turning to the next figure, FIG. 4 illustrates the underside of one embodiment of the present invention without straps 16. Specifically, protective cover 10, comprising bottom layer of high friction fabric 24, first groove 26 configured to contour a neck region of a person, second groove 27 configured to contour around the an arm region of the person, stitching 18 that connects higher absorptive capacity region 14 to cover 10, and trim region 15 encompassing an outer region of cover 10.

In one embodiment, as shown in FIG. 4, cover may not have straps 16, which may depend on the user's preference. Cover 10 maintains its position on user by higher absorptive capacity region 14. As explained above, bottom layer of high friction fabric 24 may be made of a material that has a high friction, but one that will not damage or otherwise affect the user's skin or clothing.

In using this embodiment of cover 10, the user would place cover 10 such that first groove 26 is configured to contour the user's neck region and second groove 27 configured to contour around the user's arm region. The user would then place the infant's head on or near cover 10 and feed, burp or play with the infant.

Figure 5:
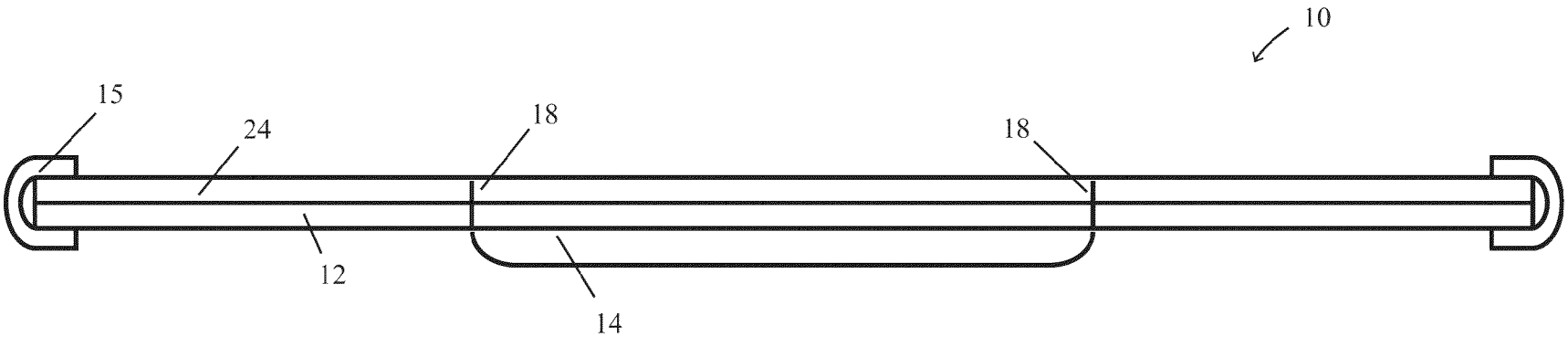
FIG. 5 illustrates a cross-sectional view taken along the line A-A in FIG. 2.

Turning to the next figure, FIG. 5 illustrates a cross-sectional view taken along cross-section line A-A in FIG. 2. Specifically, protective cover 10, comprising top layer of fabric 12, bottom layer of high friction fabric 24, higher absorptive capacity region 14, trim region 15 encompassing a outer region of cover 10, and stitching 18 that connects region 14 of higher absorptive capacity to cover 10.

As shown in FIG. 5, stitching 18 may connect higher absorptive capacity region 14 to cover 10. As explained above, higher absorptive capacity region 14 may be glued onto the cover 10 or attached to cover 10 by hook and loop fastener. Furthermore, higher absorptive capacity region 14 may be disposable or replaceable. A user may clean one higher absorptive capacity region 14 while replacing it with another higher absorptive capacity region 14 in the meanwhile.

In one embodiment higher absorptive capacity region 14 may be thicker in width than surrounding top layer of fabric 12 and bottom layer of high friction fabric 24. In another embodiment trim region 15 encompassing an outer region of a fabric may be thicker in width than top layer of fabric 12 and bottom layer of high friction fabric 24 it encompasses so as to provide additional absorption quality to cover 10.

An apparatus and method for a protective cover has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

What is claimed is:

1. A cover to protect a shoulder region of a person against expulsions from an infant's facial region, comprising:

a first fabric layer including a first groove configured to contour a neck region of the person, and a second groove configured to contour an arm region of the person;

a second fabric layer of higher fluid absorbency and a smaller surface area than said first fabric layer; and a strap configured to securely wrap around the neck of the person, wherein the second fabric layer comprises a narrow strip extending from end to end of the first fabric layer and perpendicular to a line intersecting an apex of the first groove and an apex of the second groove.

2. The cover of claim 1, further comprising a trim region encompassing an outer region of said cover.

3. The cover of claim 1, wherein said strap is elastic.

4. The cover of claim 1, further comprising a high friction fabric layer.

5. The cover of claim 1, wherein said strap comprises a plurality of straps.

6. The cover of claim 5, wherein said plurality of straps comprises a surface structure appropriate for secure attachment by a hook and loop fastener.

7. A cover to protect a shoulder region of a person against expulsions from an infant's facial region, comprising:

a first fabric layer including a first groove configured to contour a neck region of the person, and a second groove configured to contour an arm region of the person; and a second fabric layer of higher fluid absorbency and a smaller surface area than said first fabric layer, wherein the second fabric layer comprises a narrow strip extending from end to end of the first fabric layer and perpendicular to a line intersecting an apex of the first groove and an apex of the second groove.

8. The cover of claim 7, further comprising a trim region encompassing an outer region of said first fabric layer.

9. The cover of claim 7, further comprising a high friction fabric layer.

* * * * *